US008746222B2

(12) United States Patent
Jones

(10) Patent No.: US 8,746,222 B2
(45) Date of Patent: Jun. 10, 2014

(54) ARCHERY RELEASE

(75) Inventor: Brian K. Jones, Wichester, KY (US)

(73) Assignee: Scott Archery LLC, Henrietta, NY (US)

( * ) Notice: Subject to any disclaimer, the term of this patent is extended or adjusted under 35 U.S.C. 154(b) by 177 days.

(21) Appl. No.: 13/343,884

(22) Filed: Jan. 5, 2012

(65) Prior Publication Data

US 2013/0174820 A1 Jul. 11, 2013

(51) Int. Cl.
*F41B 5/18* (2006.01)

(52) U.S. Cl.
USPC ..... 124/35.2

(58) Field of Classification Search
USPC ..... 124/35.2
See application file for complete search history.

(56) References Cited

U.S. PATENT DOCUMENTS

| | | | | |
|---|---|---|---|---|
| 228,302 | A | 6/1880 | Beard | |
| 229,089 | A | 6/1880 | Burnham | |
| 3,954,095 | A | 5/1976 | Lewis | |
| 4,036,204 | A | 7/1977 | Scott | |
| 4,160,437 | A | 7/1979 | Fletcher | |
| 4,391,263 | A * | 7/1983 | Dodge | 124/35.2 |
| 4,539,968 | A * | 9/1985 | Garvison | 124/35.2 |
| 4,567,875 | A | 2/1986 | Fletcher | |
| 4,574,767 | A | 3/1986 | Gazzara | |
| 4,620,523 | A | 11/1986 | Peck | |
| 4,674,469 | A | 6/1987 | Peck | |
| 4,881,516 | A | 11/1989 | Peck | |
| 5,205,268 | A | 4/1993 | Savage | |
| 5,261,581 | A | 11/1993 | Harden, Sr. | |
| 5,448,983 | A | 9/1995 | Scott | |
| 5,595,167 | A | 1/1997 | Scott | |
| 5,596,977 | A | 1/1997 | Scott | |
| 5,765,536 | A | 6/1998 | Scott | |
| 5,803,068 | A | 9/1998 | Summers | |
| 5,850,825 | A | 12/1998 | Scott | |
| 6,032,661 | A | 3/2000 | Goff et al. | |
| 6,631,709 | B2 | 10/2003 | Carter et al. | |
| 6,763,819 | B2 * | 7/2004 | Eckert | 124/35.2 |
| 6,895,951 | B2 | 5/2005 | Summers et al. | |
| 7,278,415 | B2 | 10/2007 | Jones | |
| D597,164 | S | 7/2009 | Jones | |
| 7,753,043 | B1 | 7/2010 | Eckert | |
| 7,926,475 | B2 | 4/2011 | Jones | |
| 7,946,282 | B2 | 5/2011 | Jones | |
| 2010/0108047 | A1 | 5/2010 | Jones | |

OTHER PUBLICATIONS

Various prior art releases (1) downloaded from http://www.archeryhistory.com/releases/releasespics/pse.jpg on Dec. 29, 2009.
Various prior art releases (2) downloaded from http://www.archeryhistory.com/releases/releasespics/release4.jpg on Dec. 29, 2009.
Prior art releases (3) downloaded from http://www.archeryhistory.comireleases on Jul. 21, 2011.
Prior art releases (4) downloaded from http://www.archeryhistory.comireleases on Jul. 21, 2011.
Longhorn Hunter (2010).

* cited by examiner

*Primary Examiner* — John Ricci
(74) *Attorney, Agent, or Firm* — Hiscock & Barclay, LLP

(57) ABSTRACT

An archery release including release body, a trigger and a trigger bumper, where the trigger bumper reduces or eliminates noise generated by the trigger being actuated from a holding mode to a triggered mode. The trigger bumper can be constructed from an elastomeric material adapted to deaden noise upon impact with the trigger. The trigger bumper can be joined with the release body and/or the trigger.

16 Claims, 2 Drawing Sheets

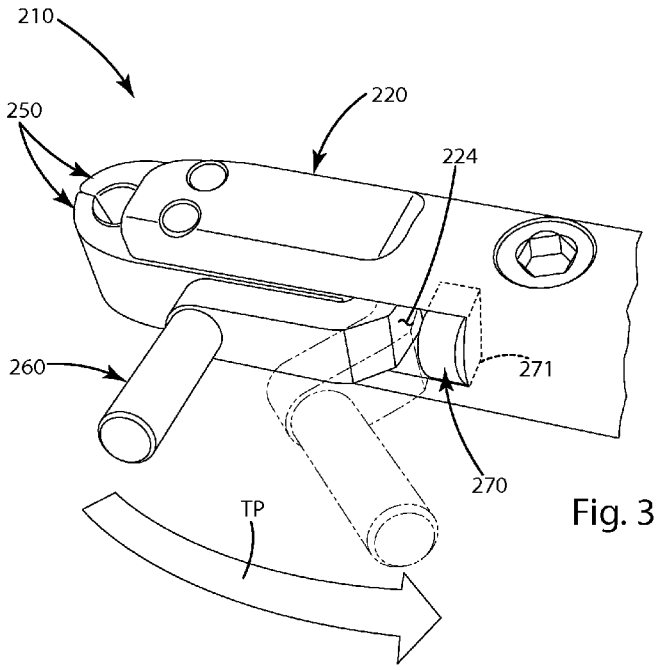
Fig. 3
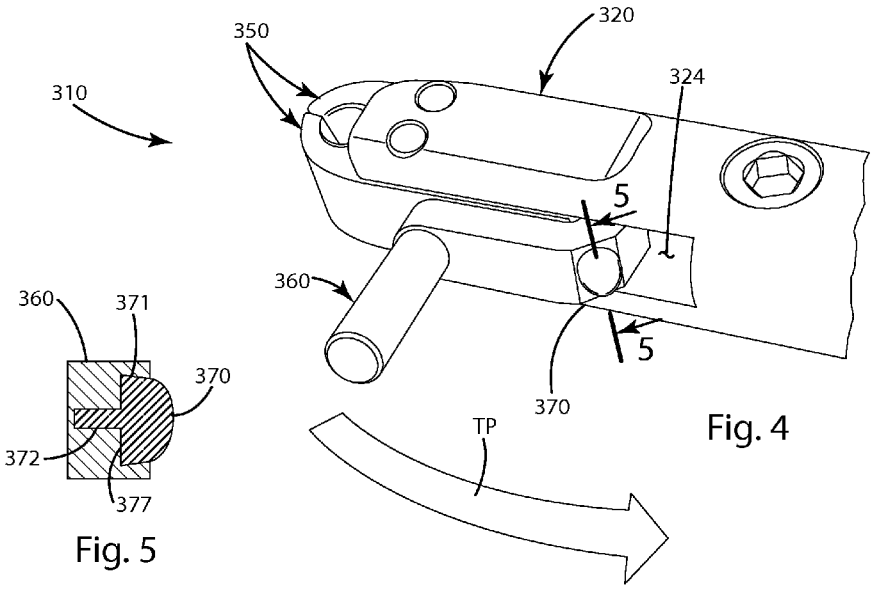
Fig. 4
Fig. 5

ARCHERY RELEASE

BACKGROUND OF THE INVENTION

Conventional archery releases are designed to temporarily hold a bowstring of an archery bow so that an archer can pull on the release and subsequently draw the bowstring to shoot an arrow from the bow. Archery releases typically assist an archer in quickly and cleanly releasing the bowstring. In general, archery releases are intended to consistently release the bowstring when the archer shoots the arrow, and thus increase the accuracy of the shot.

Most releases include a head having one or more jaws that hold the bowstring, a trigger mechanism that actuates the jaws, and a wrist strap or handle configured so that a user can hold the release. In use, an archer nocks an arrow on the bowstring and secures the jaws of the release around the bowstring or an associated loop. The user then draws the bowstring by pulling the release. After the user fully draws the bowstring, aims the bow and is prepared to shoot the arrow, the user actuates the trigger mechanism. This moves the one or more jaws and subsequently disengages the bowstring so that the bowstring can utilize its stored energy and propel the arrow from the bow.

A common issue with releases that include a trigger mechanism is that, after actuation, the trigger ceases its movement by slapping or hitting another part of the release. For example, the trigger usually is in a static holding mode before it is actuated by the archer. In this mode, the trigger mechanism enables the release to hold a drawn bowstring. After being actuated, the trigger translates to a triggered mode, which enables the jaws to move and the release to release the bowstring. The movement of the trigger usually ceases when the trigger slaps or engages a trigger well defined by the release. This slap or engagement of the trigger against the trigger well results in an audible click or pop, particularly in conventional releases where the trigger, trigger well and release body are constructed from a metal, such as aluminum or steel.

In a situation where the release is used on a hunt for game, the audible click or pop generated via the trigger slap sometimes can spook game—or at least lead the archer to believe it may spook game. In situations where the game is spooked, the game may duck and/or move before the arrow shot from the bow reaches the game. This can result in a miss or an undesirable hit on the game.

SUMMARY OF THE INVENTION

An archery release including release body, a trigger and a trigger bumper, where the trigger bumper reduces or eliminates noise generated by the trigger being actuated from a holding mode to a triggered mode.

In one embodiment, the trigger bumper is positioned in a travel path of the trigger. The trigger bumper can be positioned near the end of the desired range of travel of the trigger, and can terminate that travel. Optionally, the trigger bumper can be located at an end of the travel path of the trigger, and can effectively interrupt and/or stop the travel of the trigger.

In another embodiment, the trigger bumper can be in the form of an o-ring. The release body or other portion of the release can define a groove that retains the o-ring in the travel path of the trigger, optionally at the end of that travel path.

In still another embodiment, the trigger can move along its travel path at least partially within a trigger recess. The groove can be aligned with a portion of the trigger recess. The o-ring can extend across or adjacent the trigger recess, generally positioned to engage the trigger and interrupt and/or stop its travel along the travel path.

In even another embodiment, the release body can define a longitudinal axis extending along its length toward one or more jaws. The trigger bumper can be joined with the release body so that it at least partially or fully circumferentiates the longitudinal axis. Optionally, the trigger bumper can be located in a plane that is transverse and/or generally orthogonal to the longitudinal axis.

In yet another embodiment, the trigger recess can extend along the release body. A jaw can be located at least partially within the trigger recess, immediately adjacent the trigger. The trigger can be configured to disengage the jaw or a component associated with the jaw, and in so doing, move away from the jaw toward the trigger bumper until it engages and stops at the trigger bumper.

In a further embodiment, the trigger bumper can be joined with the trigger. When the trigger reaches the end of its travel path, the trigger bumper can quietly engage a portion of the release body or some other portion of the release. Optionally, the trigger can define a trigger bumper recess within which the trigger bumper is positioned.

In still another embodiment, the trigger bumper can be constructed from a cushioning, sound deadening and/or resilient material. Optionally, the material can be at least one of an elastomer, a polymer and a natural material. Further optionally, the elastomer can be a type of rubber, thermoplastic rubber, silicone, copolymer, ethyl vinyl acetate, or similar material.

A simple and efficient archery release is provided that cleanly and quietly releases an archery bowstring. The release can address trigger slap to generally reduce or eliminate excessive noise or audible sounds generated by the release when it is actuated. As a result, the release is less likely to spook game or generate unwanted sound in use.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

BRIEF DESCRIPTION OF THE DRAWINGS

FIG. 3 is a perspective view of a first alternative embodiment of the release having an alternative trigger bumper;

FIG. 4 is a perspective view of a second alternative embodiment of the release having yet another alternative trigger bumper; and FIG. 5 is a section view of the trigger taken along line 5-5 of FIG. 4.

DETAILED DESCRIPTION OF THE CURRENT EMBODIMENTS

I. Overview and Definitions

Figure 1:
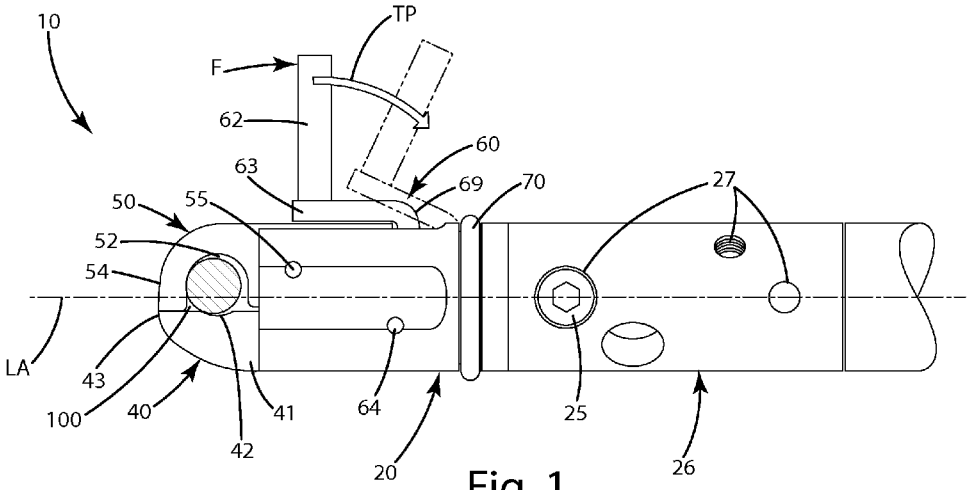
FIG. 1 is a top view of the archery release of a current embodiment in a closed position, with a trigger in a holding mode.
Figure 2:
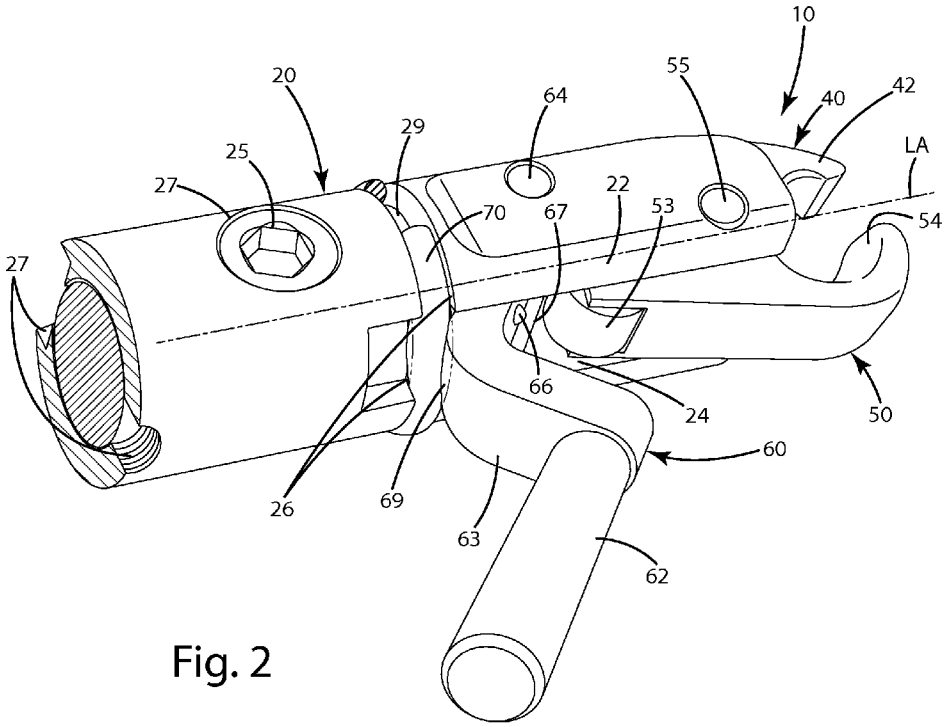
FIG. 2 is a side perspective view of the release in an open position with the trigger in a triggered mode.

An embodiment of the archery release is shown in FIGS. 1-3 and generally designated 10. The release 10 generally includes a release body 20 including a longitudinal axis LA, a fixed jaw 40, a moveable jaw 50, and a trigger 60. The trigger can include a trigger finger engagement portion 62 and a linkage element 63 that is moveably joined with the release body 20 via a trigger pivot pin 64, about which the trigger 60 can rotate and/or move.

The release can be used to assist an archer in drawing and releasing the bowstring 100. When the release is in a closed position, as shown in FIG. 1, and used to draw the bowstring 100, the trigger 60 is in the holding mode as illustrated. The trigger 60 generally prevents the jaw 50 from moving, thereby keeping the bowstring 100 captured in the bowstring notch 52. The release 10 is actuated from a closed position (FIG. 1) to an open position (FIG. 2) by a user engaging and actuating the trigger engagement portion 62 with a force F sufficient to rotate the trigger 60 about the trigger pivot pin 64. After the force F has moved the trigger 60 sufficiently, the trigger moves along a travel path TP, which as shown can be a curvilinear path about the pivot pin 64, but of course, can be any other curvilinear path, linear path, or combinations thereof as desired.

The movement of the trigger 60 continues along the travel path TP in the triggered mode until the trigger engages the trigger bumper 70, at which point the movement of the trigger is interrupted, and optionally stops. The trigger bumper can be constructed from an elastomeric material, so when the trigger 60 engages the bumper 70, there is minimal noise or sound emitted due to the collision. In effect, the trigger bumper can reduce and/or eliminate the sound emitted by the trigger as movement of the trigger terminates in the triggered mode.

As used herein, "bowstring" refers to an actual bowstring of an archery bow and any device or component adapted to join with a bowstring of an archery bow and aid an archer in drawing or releasing the bowstring, including rope loops, which are attached to the bowstring above and/or below the location where an arrow nock rests, and receivers, for example, a metal loop or partial loop that is joined with the bowstring above and below, or only above, or only below the location where the arrow nock rests on the bowstring.

As used herein "archery bow" refers to any compound bow, recurve bow, long bow, crossbow or any other device that propels or is capable of propelling an arrow, bolt or similar projectile.

As used herein "bowstring facing surface" refers to one or more surfaces of a fixed jaw which at least momentarily faces the bowstring as an opposing, moveable jaw is in its open position or closed position. The bowstring facing surface need not be adjacent and facing the bowstring when the moveable jaw and/or release is in a closed position. For example, the bowstring facing surface may be located slightly forward of the bowstring, yet still considered a bowstring facing surface.

Further, although the releases illustrated and described herein are generally fixed jaw, single caliper wrist strap releases, the constructions herein are well suited for any other type of archery release including, but not limited to, rope releases, back tension releases, thumb releases, plunger releases, pinky releases, releases with or without wrist straps, hunting releases, target releases, and the like.

II. Components

Referring to FIGS. 1-2, the components of the release 10 will now be described in detail. The release body 20 can define a recess 24 sufficiently sized to house all or a portion of the other components, such as the trigger 60 and moveable jaw 50 of the release 10. The release body 20 can define apertures to accommodate various pivot elements, such as pins, to join the trigger 60 and moveable jaw 50 with the release body. The release body can include a longitudinal axis LA which generally extends the length of the release body 20.

The release body 20 can be joined to a base 26. The base can be a shaft or other structure adapted to join the release body with a handle (not shown) or wrist strap (not shown). An exemplary construction for a handle is a simple T handle including one or more grooves for the digits of an archer's hand. Other handle constructions may be substituted as desired. An exemplary wrist strap is shown in U.S. Pat. No. 5,595,167 to Scott, which is hereby incorporated by reference. Other buckle, Velcro® or loop wrist straps may be substituted as desired.

Optionally, the base 26 can include an adjustment mechanism 27 including a fastener 25 that is positionable in one of multiple preselected holes 27 to adjust the distance between the release body and the release strap and/or handle. One suitable adjuster is described in U.S. Pat. No. 5,596,977 to Scott, which is hereby incorporated by reference. Another, different adjuster suitable for use with the release is described in U.S. Pat. No. 7,278,415 to Scott, which is hereby incorporated by reference.

The release body 20 can include an integral or non-integral fixed jaw 40. The fixed jaw 40 can extend forwardly from the release body 20. The fixed jaw 40 can include a release body end 41 located proximal to the release body 20, and a terminating end 43 which is distal from the release body 20. Generally, the terminating end 43 is passed by a bowstring 100 released from the release 10. The fixed jaw 40 can also include a bowstring facing surface 42, which can be of a variety of configurations depending on the application. Of course, in some constructions including only a moveable jaw, or multiple moveable jaws, the fixed jaw can be absent from the release 10.

The moveable jaw 50 can be constructed in a variety of configurations. In general, one suitable construction enables the forward end 54 of the moveable jaw 50 to move away from the fixed jaw 40. The moveable jaw 50 can be pivotally mounted via a pivot element 55 to the release body 20. At a rearward portion of the moveable jaw 50, a roller 53 can be joined with the moveable jaw 50. The roller 53 as shown is generally cylindrical and can rotate. The roller 53 can be constructed to engage the sear 67 of the trigger 60. A variety of other elements can be substituted for the roller 53, such as ball bearings, non-rotating elements, sliding elements or any structure that enables the rearward portion of the moveable jaw 50 to slide along or otherwise move relative to the trigger 60 so that the moveable jaw 50 is actuated and moves.

As shown in FIG. 1, the moveable jaw 50 defines a bowstring notch 52. The bowstring notch can include a curvilinear, planar or other smooth surface configured to minimize wear on a bowstring. The bowstring notch can face the fixed jaw 40 and can open generally facing the longitudinal axis LA of the release body. In general, the notch can be a U or V shaped opening or recess in the moveable jaw 40, generally configured to capture at least a portion of the bowstring 100.

Between the moveable jaw 50 and the fixed jaw 40, or optionally the release body 20, a bias member (not shown), such as a coil spring, a leaf spring, a rubber or other elastomeric element, can be positioned to urge the forward end 54 of the moveable jaw 50 away from the fixed jaw 40 when the trigger 60 is actuated from a holding mode to a triggered mode. The bias member can be located forward or rearward of the pivot pin 55 to assist in urging the forward end 54 of the moveable jaw away from the fixed jaw. Other mechanisms for performing similar or different movement can be substituted as desired.

The trigger 60 can include a trigger engagement portion 62 which extends outward from the release body 20. The trigger engagement portion can be accessible by an archer with one of the archer's digits, for example, a finger or thumb, depending on the desired configuration. The trigger engagement portion 62 can be joined with a linkage 63 which is further joined with a trigger pivot pin 64. The linkage can generally be in the shape of an "L" with the a corner of the "L" being located distal from the pin 64 and the engagement portion 62.

A portion of the trigger 60, for example, the linkage 63 can be located within the recess 24 defined by the release body 20. Further, the trigger can include an adjustment element 66 which, for example, can be a set screw that is threadably engaged with the trigger 60. Adjustment element 66 can be threaded inward or outward with respect to the trigger 60 to control the distance between the adjustment element 66 and the jaw roller 53, thereby adjusting the sensitivity of the trigger pull when the trigger transitions from a static holding mode shown in FIG. 1 to a triggered mode shown in FIG. 2.

The trigger 60 can include a sharp shouldered or ridged sear 67 which is adapted to engage the roller 53 as described below. The particular angle and configuration of this sear 67 can be modified to provide the desired travel and sensitivity of the trigger. Any other desired trigger adapted to move the moveable jaw 50 to release the bowstring 100 can be substituted for the illustrated trigger.

The release and its various components, such as the release body, trigger, moveable jaw and base can be constructed from a variety of materials, for example, metal, such as steel, stainless steel and aluminum, as well as other synthetic materials such as polymers, and any combination of the foregoing. Further, the release and its components can be treated with special processes, for example, anodizing, dipping or filming to provide the release and its components with a desired finish and appearance.

As shown in FIGS. 1 and 2, the trigger 60 is moveable along a travel path TP generally from the static holding mold shown in FIG. 1 to the triggered mode shown in FIG. 2. In the triggered mode shown, the moveable jaw 50 is moved sufficiently to release the bowstring 100 from the release 10. The trigger 60 is configured to engage the trigger bumper 70 in the triggered mode. For example, when the trigger reaches the end of its travel path TP, the trigger bumper 70 can engage the trigger 60 to interrupt travel of the trigger 60 along its travel path TP. Optionally, the trigger bumper 60 engages the trigger bumper sufficiently to stop any further meaningful travel along the travel path TP of the trigger and its components. With reference to FIG. 2, the trigger linkage 63 engages the trigger bumper 70 after the trigger has moved in the triggered mode to the bottom of the recess 24, also referred to as a trigger recess, defined by the release body 20. The amount of travel along the travel path and the positioning of the bumper along the travel path can be varied depending on the amount of movement of the trigger 60 that is adequate to disengage the moveable jaw 50 and release the bowstring 100.

The trigger bumper can be constructed from a cushioning, sound-deadening and/or resilient material. One such material can be an elastomeric material, such as an elastomer, a polymer and/or a natural material. More particularly, the elastomeric material can be a type of rubber, silicone, copolymer, thermoplastic rubber, ethyl vinyl acetate, or similar material that has the property of cushioning an impact of another item or structure therewith and/or reducing the amount of audible sound emitted during such impact.

As illustrated in FIGS. 1 and 2, the trigger bumper 70 can be in a form of an o-ring. Optionally, the o-ring can circumferentiate and/or surround at least a portion of the release body 20 and/or the longitudinal axis LA of the release body 20. Further optionally, the o-ring can be located in a plane that is transverse to the longitudinal axis LA. For example, the plane can be substantially orthogonal to the longitudinal axis LA. Within the plane, the o-ring can circumferentiate the longitudinal axis LA.

The o-ring can be positioned around the release body 20 in a desired location such that it overlaps at least a portion of the travel path TP of the trigger 60. Optionally, the release body 20 can define a groove 29 around at least a portion thereof. The o-ring 70 can be positioned within the groove 29. The groove 29 can constrain and hold the o-ring in a desired position, for example, at least partially overlapping the release body recess 24. Further optionally, the groove 29 can extend around a portion of the release body 20 and can terminate at opposing ends at the trigger recess 24 so that the groove opens into the recess. Of course, if desired, the trigger bumper groove 29 can be positioned so that it does not overlap with the trigger recess 24, along some other portion of the release body. Although shown in the form of an o-ring, the trigger bumper 70 can be constructed in various other geometric configurations, as described below.

The trigger bumper 70 can be placed within the travel path TP to engage any portion of the trigger 60 as desired. As illustrated, the trigger bumper is positioned along the travel path TP so that the corner 69 of the trigger linkage engages the trigger bumper 70 when the trigger 60 is in the triggered mode. If desired, the trigger bumper 70 can be moved to engage different portions of the trigger along the travel path.

The trigger bumper 70 can be configured and positioned so that it is generally disengaged from, and not in contact with, the trigger 60 in the static holding mode as shown in FIG. 1. However, after the trigger 60 is actuated from the holding mode shown in FIG. 1 to any phase of the triggered mode shown in FIG. 2, the trigger bumper can be configured to engage the trigger 60. Optionally, the trigger bumper 70 does not engage or contact the trigger until the trigger is actuated and the moveable jaw moves from a closed position toward an open position.

The trigger bumper 70 generally can be positioned within the travel path of the trigger 60 to reduce and/or eliminate the audible sound emitted when the trigger 60 is in the triggered mode, and optionally, when movement of the trigger 60 along the travel path TP terminates via engagement with the trigger bumper 70. Most humans can hear sound in the audible frequency range of about 20 hertz to about 20 kilohertz. When the release 10 including a trigger bumper 70 of the embodiments herein is used, the engagement of the trigger in the triggered mode with the trigger bumper generally can be inaudible to (unheard by) a human located at least 10 feet, 20 feet, 30 feet or 40 feet away from the release upon engagement of the trigger 60 with the trigger bumper 70. With this level of sound suppression when the trigger terminates travel, it is less likely that game will be spooked because the game likely will not be able to hear the release being actuated from the open to the closed mode, and more particularly, the trigger being engaged from the static holding mode to the triggered mode.

III. Method of Manufacture and Operation

In general, the various components of the release 10 can be molded, machined or extruded to obtain their desired configuration. The components can also be treated with special processes as described above to provide a desired finish. With the components constructed, the release 10 can be assembled.

To assemble the release, the roller 53 is joined with the moveable jaw 50, and the moveable jaw is joined with the release body 20 via the pin 55. The trigger 60 is joined with the release body 20 via the pin 64. The sensitivity of the trigger 62 can be set with the adjustment element 66, as described above. The various components can be ground or filed to remove to any excess material and lubricated to optimize movement and provide crisp actuation as desired.

The trigger bumper 70 can be formed from an elastomeric material, for example, by injection molding, pour molding, forming, die-cutting or some other operation. Where the trigger bumper 70 is in the form of an o-ring, the o-ring can be stretched to an expanded state and moved over a portion of the release body until it is aligned with the optional groove 29. The o-ring then can be positioned in the groove 29, and released somewhat from the expanded state to a smaller dimension corresponding at least partially to the dimension of the groove so that the groove captures the o-ring within it. After being installed, the trigger bumper generally is positioned within the travel path TP of the trigger 60, and optionally at least partially extends across a portion of the trigger recess 24.

In operation, an archer actuates the release 10 so that the moveable jaw is in the open position shown generally in FIG. 2. The archer then positions the fixed jaw 40 and moveable jaw 50 adjacent the bowstring 100 of the archery bow the archer intends to draw with the release 10. The release 10 grasps the bowstring 100 with the moveable jaw 50 so that the bowstring is within the notch 52. The moveable jaw 50 is then moved toward the fixed jaw 40 to capture the bowstring 100. In this configuration, the moveable jaw 50 is positioned in a closed position, as shown in FIG. 1. Moreover, at this stage, the trigger 60 is in the static holding mode as also shown there.

The archer then draws the bowstring 100 to a drawn state with the assistance of the release 10. As the bowstring 100 is drawn, it exerts its substantial force on the bowstring notch and the moveable jaw, however, the trigger 60 is positioned to hold the moveable jaw in place.

When the archer is satisfactorily aimed the bow, the archer actuates the release with the trigger 60 to release the bowstring 100. Generally the archer applies a force F as shown in FIG. 1 to the engagement portion 62 of the trigger 60. In turn, the engagement portion 62 and the trigger linkage 63 rotate about the pivot pin 64 within the release body 20, and more particularly, the recess 24. The trigger travels along the travel path TP from the static holding mode shown in FIG. 1 to the triggered mode shown in FIG. 2. As the trigger 60 travels toward the end of its travel path TP in the triggered mode, it travels within the recess 24 defined by the release. In this motion, the sear 67 passes a center line extending from the center of the pin 55 to the center of the pin 64. The moveable jaw continues to rotate, being urged away from the fixed jaw 40 in the way of a bias member (not shown) as the moveable jaw 50 open to release the bowstring 100.

As the trigger reaches the end of its travel path TP, it engages the trigger bumper 70. For example, the corner 69 of the trigger linkage 63 engages the trigger bumper 70. Being constructed from an elastomeric material, the trigger bumper can slightly deform upon engagement of the trigger with it, and such deformation can cushion the impact of the trigger 60 with the trigger bumper 70. Again, the trigger bumper 70 generally can terminate movement of the trigger 60. Forces are translated from the trigger 60 through the trigger bumper 70 to the remainder of the release body 20, however, the audible sounds generated by the transmission of those forces is significantly subdued. Specifically, the trigger bumper reduces and/or eliminates the audible sound generated when the trigger bumper stops movement of the trigger 60 along the travel path TP in the triggered mode, as shown in FIG. 2. As an example, with the use of the trigger bumper, a human listener positioned at least about 10 feet, 20 feet, 30 feet or 40 feet away from the release cannot hear the audible sound created by the engagement of the trigger with the trigger bumper. It is believed that this level of sound suppression provided by the trigger bumper, the release can be used in hunting situations without spooking the pursued game.

IV. Alternative Embodiments

Referring to FIG. 3, a second alternative embodiment of the archery release will now be described. In general, the second alternative embodiment is similar to the current embodiment described above with a few exceptions. For example, the release 210 can include two jaws 250. Such a construction is generally referred to as a dual caliper release, and both of the jaws 250 can move to release a bowstring.

As also shown in FIG. 3, the trigger bumper can be of a different construction. For example, the release body 220 can define a recess or hole 271. This recess 271 can be an extension of the trigger recess 224, or can be of a separately formed and differently shaped trigger bumper recess 270 defined in the release body 220. The trigger bumper recess 271 can be configured and located so that a trigger bumper 270 positioned therein is located within the travel path TP of the trigger 260 as it moves from the static holding mode as shown in FIG. 3 to a triggered mode. The trigger bumper 270 can be cemented, adhered, fastened or otherwise joined with the trigger recess 271.

Optionally, the trigger bumper 270 can be constructed from an elastomeric material that is sticky and adhesive when heated or otherwise first formed. This elastic material can be injected into or positioned in the trigger bumper recess 271 so as to bond directly with the material of the recess body 220 surrounding the trigger bumper recess 271. The interior of the trigger bumper recess 271 can be roughened or otherwise modified so that the surface bonds well with the elastomeric material. The trigger bumper 270 can be molded, formed or cut so that it engages the appropriate portion of the trigger 260, and cushions and/or reduces the amount of sound emitted upon engagement of the trigger 220 with the trigger bumper 270.

Further optionally, the trigger bumper 270 can be constructed from an elastomeric material, such as silicone. The silicone can be injected into the trigger recess 271. Due to adhesive properties, the silicone can adhere directly to the surfaces of the recess 271. After curing, the silicone can form the trigger bumper 270. Of course, other types of materials can be substituted for the silicone as the elastomeric material used in the trigger bumper of this embodiment.

Referring to FIG. 4, a third alternative embodiment of the archery release will now be described. In general, the third alternative embodiment is similar to the embodiments above with a few exceptions. For example, the release illustrated is a dual caliper release with opposing moveable jaws 350 joined with a release body 320. The release body 320 also includes a trigger recess 324. The trigger 360, however, is joined directly with the trigger bumper 370. In this embodiment, the trigger bumper 370 moves along with the trigger 360 through the travel path TP of the trigger 360. Thus, the trigger bumper 370 remains engaged with the trigger 360 in the static holding mode shown in FIG. 4, as well as in a triggered mode.

In the triggered mode, the trigger bumper 370 stops movement of the trigger 360 along the trigger path TP as with the embodiments above, however, the trigger bumper 370, moving with the trigger 360, engages the release body 320, and more particularly the portion of the release body 327 defined at the bottom of the recess 324. This engagement of the trigger bumper 370 with the release body effectively cushions the termination of movement of the trigger 360 along the travel path TP as with the embodiments above.

The trigger bumper 370 can be joined with a trigger in a variety of matters. For example, as shown in FIG. 5, the trigger 360 can define a trigger bumper recess 371. The trigger bumper 370 can be adhered with an adhesive 377 within the recess 371. If desired, the trigger bumper 370 can be of a mushroom shape with a projection 372 that projects into the trigger to provide additional holding strength to keep the bumper 370 secured to the trigger 360.

Optionally, as with the second alternative embodiment described above, the trigger bumper can be constructed from a silicone or some other elastomeric material which, when injected or positioned in the trigger bumper recess 371, adheres or generally bonds with the trigger 360 and/or the recess 371. Further optionally, if the elastomeric material is adhesive enough, or a suitable adhesive is used, the trigger need not define a trigger bumper recess. Instead, the trigger bumper can be adhered or cemented or otherwise fastened directly to the exterior surface of the trigger 360 in a desired location.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z. Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The embodiments of the invention in which an exclusive property or privilege is claimed are defined as follows:

1. An archery release comprising:

a release body having a longitudinal axis, the release body defining a recess;

an elongate moveable jaw joined with the release body, the moveable jaw moveable between a closed position and an open position, the moveable jaw defining a bowstring notch, the moveable jaw moveable at least partially within the recess defined by the release body, a trigger joined with the release body, the trigger joined with a trigger pivot pin, the trigger moveable along a travel path around the pivot pin, between a holding mode and a triggered mode, the trigger being located at least partially within the recess defined by the release body;

a trigger bumper disposed within the travel path of the trigger so as to stop movement of the trigger along the travel path, the trigger bumper constructed from an elastomeric material, wherein the trigger bumper at least one of reduces and eliminates an audible sound generated when the trigger bumper stops movement of the trigger along the travel path, and wherein the release body defines a groove that is transverse to the travel path of the trigger, wherein the trigger bumper is positioned in the groove.

2. The archery release of claim 1 wherein the trigger rotates about the trigger pivot pin as the trigger moves along the travel path between the holding mode and the triggered mode, wherein the bowstring notch of the elongate moveable jaw projects forward of a forward most end of the release body.

3. The archery release of claim 1 wherein the trigger is constructed from metal, wherein the release body is constructed from metal, and wherein the elastomeric material is rubber.

4. An archery release comprising:

a release body having a longitudinal axis, the release body defining a recess;

an elongate moveable jaw joined with the release body, the moveable jaw moveable between a closed position and an open position, the moveable jaw defining a bowstring notch, the moveable jaw moveable at least partially within the recess defined by the release body, a trigger joined with the release body, the trigger joined with a trigger pivot pin, the trigger moveable along a travel path around the pivot pin, between a holding mode and a triggered mode, the trigger being located at least partially within the recess defined by the release body;

a trigger bumper disposed within the travel path of the trigger so as to stop movement of the trigger along the travel path, the trigger bumper constructed from an elastomeric material, wherein the trigger bumper at least one of reduces and eliminates an audible sound generated when the trigger bumper stops movement of the trigger along the travel path, and wherein the trigger bumper circumferentiates the release body and is positioned at least partially within the recess of the release body.

5. The archery release of claim 4 wherein the trigger bumper is an o-ring, wherein the o-ring is positioned in a plane that is generally orthogonal to the longitudinal axis of the release body.

6. An archery release comprising:

a release body having a longitudinal axis, the release body defining a recess;

an elongate moveable jaw joined with the release body, the moveable jaw moveable between a closed position and an open position, the moveable jaw defining a bowstring notch, the moveable jaw moveable at least partially within the recess defined by the release body, a trigger joined with the release body, the trigger joined with a trigger pivot pin, the trigger moveable along a travel path around the pivot pin, between a holding mode and a triggered mode, the trigger being located at least partially within the recess defined by the release body;

a trigger bumper disposed within the travel path of the trigger so as to stop movement of the trigger along the travel path, the trigger bumper constructed from an elastomeric material, wherein the trigger bumper at least one of reduces and eliminates an audible sound generated when the trigger bumper stops movement of the trigger along the travel path, and wherein the trigger bumper is joined with the trigger and moves with the trigger along the trigger travel path.

7. The archery release of claim 6 wherein the trigger includes an engagement end configured so that a user can manually engage the trigger, and wherein the trigger includes a linkage, the linkage defining a linkage recess, the trigger bumper positioned in the linkage recess.

8. An archery release comprising:

a release body;

a jaw defining a bowstring notch configured to hold a bowstring, the jaw joined with the release body;

a trigger joined with the release body, the trigger moveable along a travel path from a holding mode to a triggered mode; and a trigger bumper constructed from an elastomeric material disposed in the travel path of the trigger and configured to interrupt travel of the trigger along the travel path in the triggered mode, wherein the trigger bumper is an o-ring, wherein the release body defines a groove, wherein the o-ring is positioned in the groove.

9. The archery release of claim 8 wherein the trigger bumper is positioned to stop travel of the trigger along the travel path when the trigger engages the trigger bumper in the triggered mode.

10. The archery release of claim 9 wherein the engagement of the trigger with the trigger bumper is inaudible to a human listener positioned at least 20 feet away from the release.

11. The archery release of claim 8 comprising a trigger pivot pin joining the trigger to the release body, the trigger configured to pivot about the trigger pivot pin.

12. The archery release of claim 8 wherein the release body defines a longitudinal axis, wherein the trigger bumper is positioned around at least a portion of the longitudinal axis.

13. The archery release of claim 8 wherein the trigger bumper is distal and disengaged from the trigger when the trigger is in the holding mode.

14. An archery release comprising:

a release body;

a jaw defining a bowstring notch configured to hold a bowstring, the jaw joined with the release body;

a trigger joined with the release body, the trigger moveable along a travel path from a holding mode to a triggered mode; and a trigger bumper constructed from an elastomeric material disposed in the travel path of the trigger and configured to interrupt travel of the trigger along the travel path in the triggered mode, wherein the trigger bumper is joined with and moves with the trigger.

15. An archery release comprising;

a release body including a jaw defining a bowstring notch;

a trigger joined with the release body; and a trigger bumper constructed from an elastomeric material, the trigger bumper disposed in a travel path of the trigger and configured to interrupt movement of the trigger along the travel path after the trigger transitions from a holding mode to a triggered mode, wherein the trigger bumper is selected from a group consisting of (1) an o-ring, wherein the release body defines a groove and the o-ring is positioned in the groove and (2) an elastomeric protrusion joined with the trigger that moves with the trigger along the travel path.

16. The release of claim 15 comprising a trigger pivot pin, the trigger mounted to the trigger pivot pin, wherein the trigger rotates about the trigger pivot pin along the travel path.

* * * * *